US009496981B2

(12) United States Patent
Bernstein et al.

(10) Patent No.: US 9,496,981 B2
(45) Date of Patent: Nov. 15, 2016

(54) SYSTEM AND METHOD OF MASKING ELECTROMAGNETIC INTERFERENCE (EMI) EMISSIONS OF A CIRCUIT

(75) Inventors: Kerry Bernstein, Underhill, VT (US); Sebastian T. Ventrone, South Burlington, VT (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 954 days.

(21) Appl. No.: 12/507,481

(22) Filed: Jul. 22, 2009

(65) Prior Publication Data

US 2011/0019819 A1 Jan. 27, 2011

(51) Int. Cl.
*H04K 1/02* (2006.01)
*H04K 3/00* (2006.01)

(52) U.S. Cl.
CPC ..... *H04K 3/825* (2013.01); *H04K 3/42* (2013.01)

(58) Field of Classification Search
CPC ..... H04K 1/02; H04K 3/42; H04K 3/825; H04H 20/31; H04H 20/14; H04H 60/13; H04H 60/17
USPC ..... 380/252, 253; 375/130
See application file for complete search history.

(56) References Cited

U.S. PATENT DOCUMENTS

| | | | | |
|---|---|---|---|---|
| 4,320,765 | A * | 3/1982 | Cathignol et al. | 600/455 |
| 5,793,328 | A * | 8/1998 | Ward et al. | 342/357.69 |
| 6,088,595 | A * | 7/2000 | Ciccone et al. | 455/463 |
| 6,182,011 | B1 * | 1/2001 | Ward | 701/479 |
| 6,226,491 | B1 * | 5/2001 | Wachs et al. | 455/12.1 |
| 6,480,699 | B1 * | 11/2002 | Lovoi | 455/41.2 |
| 7,305,020 | B2 | 12/2007 | Tran et al. | |
| 7,386,028 | B2 | 6/2008 | Egan et al. | |
| 7,400,194 | B2 | 7/2008 | Kuehnel | |
| 2007/0285163 | A1 * | 12/2007 | Kuehnel | 330/251 |
| 2008/0254754 | A1 * | 10/2008 | Van Waasen | H03D 7/1441 455/91 |

* cited by examiner

*Primary Examiner* — Baotran N To
(74) *Attorney, Agent, or Firm* — David Cain; Andrew M. Calderon; Roberts Mlotkowski Safran Cole & Calderon P.C.

(57) ABSTRACT

A system is provided for securing information residing on a circuit (e.g., processor). In particular, a system and method is provided for masking electromagnetic interference (EMI) emissions emitting from a circuit using a random noise generator in combination with a low noise amplifier and antenna. The random number generator matches a frequency of a circuit to be protected, and generates a random signal to be superimposed on data. The low noise amplifier receives the random signal from the random number generator, and an antenna receives the random signal from the low noise amplifier and transmits the random signal to mask the data of the circuit to be protected.

23 Claims, 2 Drawing Sheets

SYSTEM AND METHOD OF MASKING ELECTROMAGNETIC INTERFERENCE (EMI) EMISSIONS OF A CIRCUIT

FIELD OF THE INVENTION

The invention relates to a system for securing information residing on a circuit (e.g., processor) and, more particularly, to a system and method of masking electromagnetic interference (EMI) emissions emitting from a circuit using a random noise generator in combination with a low noise amplifier and antenna.

BACKGROUND OF THE INVENTION

The surreptitious observation of microprocessor function(s) has become a concern to many designers. For example, the surreptitious observation of microprocessor function(s) by an unauthorized entity can result in such entity being able to illegally appropriate highly confidential and proprietary information. However, to obtain such information requires a large amount of data to understand the functions of the processor. So, even if the unauthorized entity has access to the processor, it is still exceedingly difficult to store the data needed for any length of time in a processor without detecting a new memory array.

As it remains exceedingly difficult to store the data needed for any length of time in a processor without detecting a new memory array, it becomes necessary for the unauthorized entity to spirit away machine information in real time through an existing information path. The venues available to do this include, for example, conventional pins (i.e., JTAG), power or heat signatures, backside photoemissions, or most likely electromagnetic emissions. As to the latter possibility, chip electromagnetic emissions are readily available and can easily be recorded and decoded. While the designer (and others) considers this electromagnetic interference (EMI) to be undesirable, this is precisely what can be used to spy on machine functions and, once decoded, obtain the highly confidential and proprietary information. To do this, an unauthorized entity can readily pick up these RF signals and use them to help deduce what the chip is doing, and what data it is doing it on.

Accordingly, there exists a need in the art to overcome the deficiencies and limitations described hereinabove.

SUMMARY

In a first aspect of the invention, a system comprises a random number generator which matches a frequency of a circuit to be protected, and which generates a random signal to be superimposed on data. The system further comprises a low noise amplifier which receives the random signal from the random number generator. An antenna receives the random signal from the low noise amplifier and transmits the random signal to mask the data of the circuit to be protected.

In another aspect of the invention, a system is structured to mask data from a circuit. The system comprises a random number generator coupled to a circuit, a low noise amplifier coupled to the random number generator, and an antenna coupled to the low noise amplifier. The random number generator is operated at a frequency consistent with the circuit or a function of the circuit to be protected and generates random data superimposed on native electromagnetic interference (EMI) emissions originating from the circuit or the function of the circuit to be protected. The antenna transmits the random data to mask the data of the circuit to be protected.

In yet another aspect of the invention, a method comprising: generating random data; superimposing the random data on native electromagnetic interference (EMI) emissions originating from a circuit or function of the circuit to be protected and at a frequency consistent with the circuit or the function of the circuit to be protected; and transmitting the random data such that the transmitted random data masks the native electromagnetic interference (EMI) emissions originating from the circuit or the function of the circuit to be protected.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

The invention relates to a system for securing information residing on a circuit (e.g., processor) and, more particularly, to a system and method of masking electromagnetic interference (EMI) emissions native to a circuit using a random noise generator in combination with a low noise amplifier. In embodiments, the present invention is a system which is structured to mask the EMI signature of a circuit, function or IC which prevents reverse engineering or monitoring of its operation. In this way, the present invention increases product security.

More specifically, the present invention includes an EMI generator incorporated into a circuit, function or IC to mask the native EMI signature of the circuit. In embodiments, the EMI generator includes a random number generator, a low noise amplifier and an antenna. In operation, the EMI generator is operated at a frequency consistent with the function to be protected but with random data to ensure that the superimposed data cannot be filtered, i.e., so that it is not possible to deconvolve and decode out the superimposed signal. A control macro can balance the random number generator (at a matched frequency of the circuit) with the functions, data, etc. of the circuit, creating a random number seed that sets an ever changing transmitting signal such that the actual electrical emissions of the active circuits are corrupted when monitored by a listening device. In this way, the real function of the active circuits cannot be detected.

Figure 1:
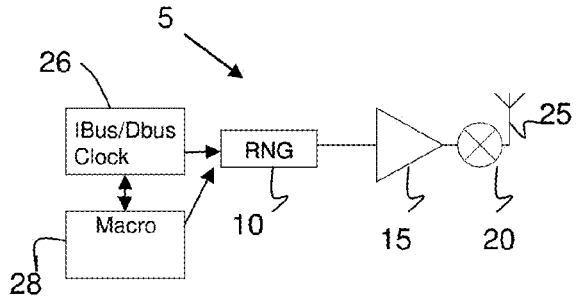
FIG. 1 is a block diagram of architecture (system) in accordance with aspects of the invention.

FIG. 1 is a block diagram of an architecture (system) in accordance with aspects of the invention. Specifically, FIG. 1 shows a system 5 comprising a random noise generator (RNG) 10 coupled to a low noise amplifier (LNA) 20. The RNG 10 is also coupled to a data bus/clock (conventional bus data) 26 of a circuit (also referred to and used interchangeably with a "processor"). The amplifier 20 should be a LNA so that the output of the RNG 10 is the predominant signal fed to downstream components (e.g., mixer and antenna). As discussed further below, the RNG 10 is operated at a frequency consistent with the data bus 26, but with a random signal superimposed onto the native signal (EMI) of the circuit or function to be protected. The random signal (e.g., random number seed) sets an ever changing transmitting signal which will mask the signal (EMI) of the active circuit or function thereof.

In embodiments, the operating frequency of the RNG 10 can be controlled by a control macro 28 (e.g., state machine or micro code). Those of skill in the art will recognize that the control macro 28 is capable of determining the frequency of the data bus 26 and provide such information to the RNG 10, regardless of the changing frequency of the data bus 26. For example, the control macro 28 is capable of determining a decrease in the clock rate frequency when battery power is running low and providing such information to the RNG 10. In turn, the RNG 10 will use this updated information to adjust its frequency consistent with that of the clock rate frequency.

Those of skill in the art should recognize that using the same operating frequency for the RNG 10 and the circuit (clock frequency of the data bus) will ensure that the frequency of the RNG cannot be demodulated (e.g., filtered). In this way, it would not be possible to obtain the signal (EMI) of the circuit thereby ensuring that the data (signal) of the circuit cannot be surreptitiously obtained by an unauthorized entity, and will thus remain secure.

Still referring to FIG. 1, the output of the LNA 20 may be mixed conventionally as in normal RFCMOS, if desired, by a mixer 15. In embodiments, the mixer 15 provides a reduced current consumption and can perform power amplification as needed at the output, and the resulting modulated signal can be output to a high gain antenna (HGA) 25 without an intermediate power amplification stage. The mixer 15 can also accept as its input frequencies (signals) from the RNG 10 and can present at its output any combination of (i) a signal equal in frequency to the sum of the frequencies of the input signals, (ii) a signal equal in frequency to the difference between the frequencies of the input signals, and/or (iii) the original input frequencies.

In embodiments, the output of the high performance LNA 20 is timed at precisely the instruction and data bus frequency, and fed to the high gain antenna (HGA) 25. That is, initially the RNG 10 outputs a stream of data at the same rate as the instruction and data bus frequency coming into the processor from, for example, an L2 cache. This output will then drive the LNA 20, which is fed to the HGA 25. In embodiments, the HGA 25 may be formed using the metallization of the logic chip. The HGA 25, using the random data, will then emit an obfuscating signal at precisely the correct frequency. More specifically, the random stream of data output from the HGA 25 (as generated by the RNG 10) will mask (corrupt) the signal data from the processor and, as the stream of data is random, it will not be possible to deconvolve and decode out the superimposed signal. This will ensure that the original signal of the circuit remains secure.

In embodiments, the HGA 25 can be embedded in the processor, and can output the random pattern of the RNG 10 which obfuscates the actual intrinsic emissions arising from the conventional bus data (e.g., L2 cache). In known systems, the L2 cache can be used by a central processing unit (CPU) of a computer to reduce the average time to access memory. The cache can store data read by the CPU and can include data that is to be masked by the present invention. The L2 cache can also bring data onto the circuit if the data bus is too small to handle the data in an efficient manner.

Still referring to FIG. 1, the power output of the HGA 25 is sufficient to mask the bus traffic, but not too high to couple too strongly to the bus 26 and interfere with driver functions. In specific embodiments, the signal on the HGA 25 is uncorrelated and should exhibit no net bias on the data bus 26. Further, with appropriate construction, the HGA 25 will present to the processor as common mode noise. In addition, at times, the HGA 25 can be attenuated so that it remains in sync with the remaining components of the system 5.

Figure 2:
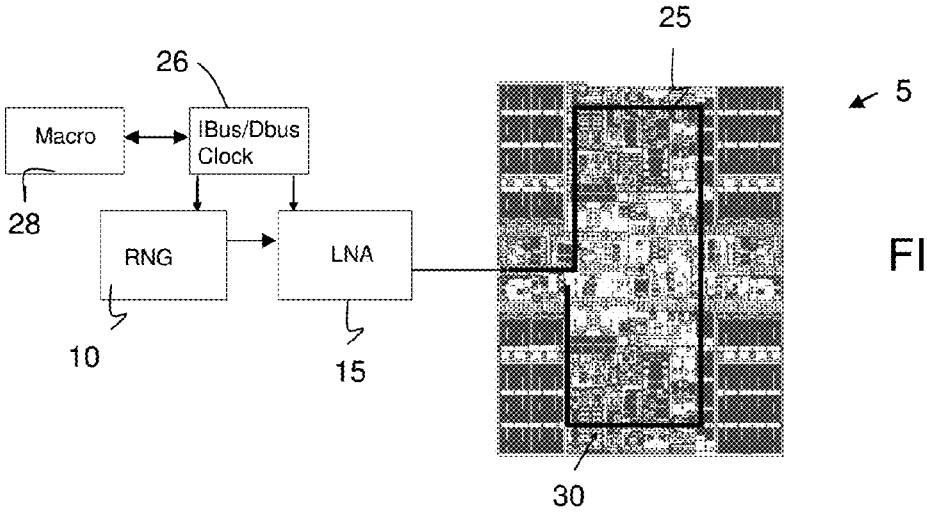
FIG. 2 is a block diagram of architecture (system) in accordance with aspects of the invention.

FIG. 2 is a block diagram of an architecture (system) in accordance with another aspect of the invention. The system 5 of FIG. 2 is substantially identical to that of FIG. 1, with the exceptions noted below. In FIG. 2, for example, the system does not include the mixer. The system 5 of FIG. 2 also shows the HGA 25 embedded in the processor 30. In embodiments, the RNG 10 and/or the LNA 20 can be embedded in the processor 30. In further embodiments, the RNG 10 and the LNA 20 can both be coupled to the data bus 26. Also, the control macro of FIG. 1 can be, for example, embedded within the processor and/or part of the data bus 26.

As in the previous embodiment, the RNG 10 will generate a random data signal at the timed frequency of the circuit. As the data is random, it will not be possible to deconvolve and decode out the superimposed signal thus ensuring that the original (native) signal of the circuit and/or function will remain secure. Also, as in the previous embodiment, the power of the random EMI is sufficient to confound eavesdropping, but low enough to not interfere with instruction and data bus signal. For example, the power of the system is tuned to provide adequate masking of the native EMI signature of the circuit while minimizing required power so as not to corrupt the function of the circuit.

In embodiments, the system of the invention can be turned on and off for test purposes. Also, the present invention can be extended to include areas beyond memory macros. For example, often the algorithms for a data bus are in circular loops that have sparse memory requests. In order to protect the internal loops, the same methodology and system can be extended to internal data paths, and also arithmetic units. In this example, the RNG can change frequency (for different applications) and include more than one RNG to be located closer to the active circuits.

In embodiments, a CPU can be architected and provided to help facilitate the synchronization and potential random number seed tuning. Depending upon the location of active data paths, each RNG can be any of tuned/started/halted to provide the cover of the ongoing background function. Sufficient replacement seeds can also be queued up and the RNG phased over to new random patterns at a sufficient rate to prevent external reverse engineering of any data. Hence, the RNG can be synchronized to the generated pattern to the workload and instruction to be retired, accomplished via predecoding or "snooping" incoming operands. Alternately, transition detectors may be used to key the specific local RNG such that it effectively masks the unit.

Figure 3:
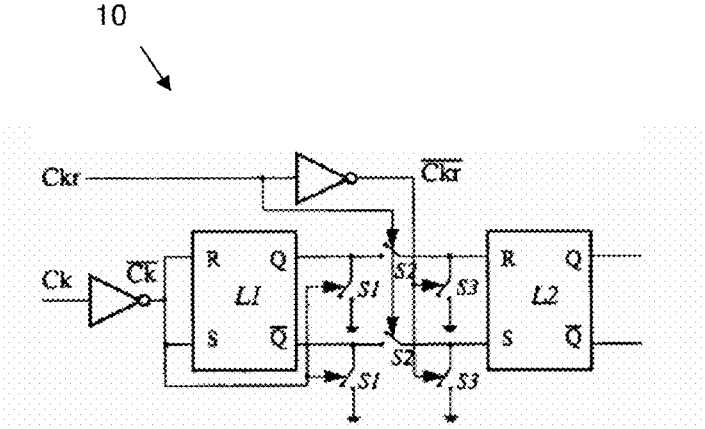
FIG. 3 is an exemplary random noise generator used with the system of the invention.

FIG. 3 is an exemplary random noise generator (RNG) 10 used with the system of the invention. Specifically, the RNG 10 includes circuitry that generates random numbers from a physical process which are completely random and unpredictable. In embodiments, the RNG 10 can take many forms or schemas to convert the output into a digital representation, such as a binary digit 0 or 1, varying with time. In embodiments, the RNG 10 can also be software, running on the CPU to be protected, for example.

Although no specific RNG 10 is required by the present invention, as there exists multiple approaches contemplated by the invention, the RNG shown in FIG. 3 shows an out-of phase chopper clock used to corrupt intermediate states in an L1/L2 latch which is closed at yet a different clock frequency. The RNG 10 shown in FIG. 3 is also provided in CMOS.

Figure 4:
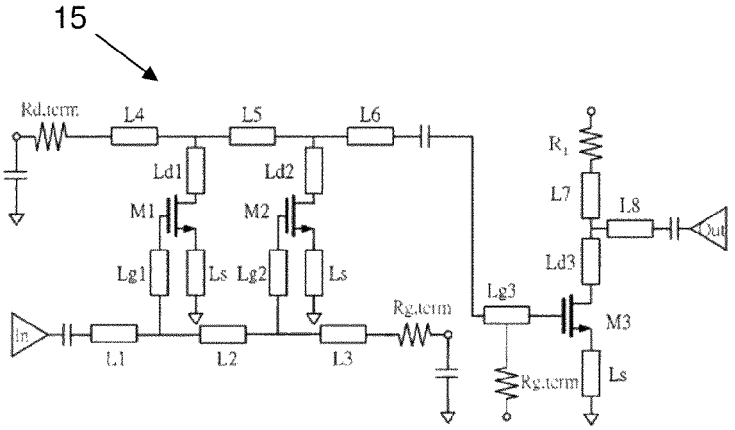
FIG. 4 is an exemplary low noise amplifier used with the system of the invention.

FIG. 4 is an exemplary low noise amplifier (LNA) 20 used with the system of the invention. Specifically, the LNA 20 includes circuitry to amplify the signals captured from the RNG. As should be understood by those of skill in the art, using an LNA 20, the noise of subsequent stages is reduced by the gain of the LNA 20, while the noise of the LNA 20, itself, is injected directly into the received signal. The LNA 20 is configured to boost the desired signal power while adding as little noise and distortion as possible so that the retrieval of this signal is possible in the later stages in the system. In the particular LNA 20 shown in FIG. 4, a signal is fed through an amplifier which first removes common mode noise before finally applying gain to the remainder signal. Those of skill in the art should also realize that the LNA 20 shown in FIG. 4 should not be considered a limiting feature of the claimed invention, in that other LNAs are also contemplated herein.

Figure 5:
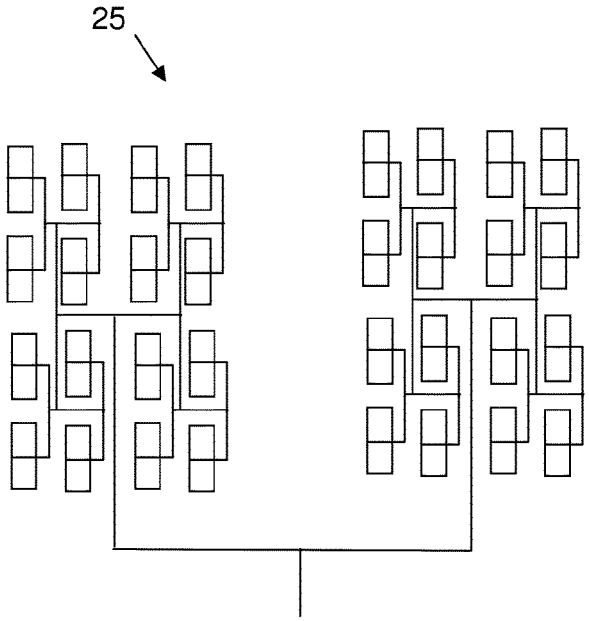
FIG. 5 is an exemplary antenna used with the system of the invention.

FIG. 5 is an exemplary antenna used with the system of the invention. Specifically, FIG. 5 shows a high gain antenna (HGA) 25. The HGA 25 is, in embodiments, a strip line feed network comprising a 4×8 slot array. The HGA 25 is capable of supporting the bandwidth necessary to match the databus frequency to be obfuscated. Also, the HGA 25 is designed such that signal lobes of the antenna correctly overlay the emissions of the sensitive busses. In the example shown, a 4×8 slot array provides effective coverage, although any number of other designs could be equally effective at convolving random noise and buss data signal.

In embodiments, the HGA 25 can be a directional antenna with a focused, narrow radio wave beam width. This narrow beam width allows more precise targeting of the radio signal. Those of skill in the art should appreciate that the HGA as a consequence of their directivity, directional antennas also send less (and receive less) signal from directions other than the main beam. As an alternative embodiment, the HGA can also be a bi-directional antenna.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below, where applicable, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. Accordingly, while the invention has been described in terms of embodiments, those of skill in the art will recognize that the invention can be practiced with modifications and in the spirit and scope of the appended claims.

What is claimed:

1. A system comprising:

a random number generator which matches a frequency of a circuit to be protected, and which generates a random signal to be superimposed on data;

a low noise amplifier which receives the random signal from the random number generator;

an antenna which receives the random signal from the low noise amplifier and transmits the random signal to mask the data of the circuit to be protected;

a mixer coupled to the low noise amplifier, wherein the mixer provides a reduced current consumption and performs power amplification as needed at the output, and a resulting modulated signal is output to the antenna without an intermediate power amplification stage; and a control macro which determines a decrease in clock rate frequency when battery power is running low and provides updated information to the random number generator which then uses the updated information to adjust its frequency consistent with that of a clock rate frequency, wherein the random signal superimposed on the data cannot be filtered from the data.

2. The system of claim 1, wherein the random number generator masks native electromagnetic interference (EMI) emissions originating from the circuit to be protected.

3. The system of claim 1, wherein the random number generator is embedded into the circuit.

4. The system of claim 1, wherein the random number generator is operated at a frequency consistent with the circuit or a function of the circuit to be protected and generates the random signal to be superimposed on native electromagnetic interference (EMI) emissions originating from the circuit or the function of the circuit to be protected.

5. The system of claim 1, wherein the random noise generator is coupled to the low noise amplifier and a data bus/clock.

6. The system of claim 1, wherein the control macro is further structured to determine an operating frequency of the circuit and to synchronize a frequency of the random number generator with the operating frequency of the circuit.

7. The system of claim 1, wherein the mixer accepts as its input frequencies from the random number generator and presents at its output at least one of: (i) a signal equal in frequency to a sum of the frequencies, (ii) a signal equal in frequency to a difference between the frequencies, and (iii) the frequencies from the random number generator.

8. The system of claim 1, wherein the antenna is a high gain antenna.

9. The system of claim 1, wherein the antenna emits an obfuscating signal at precisely a same frequency of the circuit.

10. The system of claim 9, wherein the antenna has a power output sufficient to mask bus traffic of the circuit, and not interfere with driver functions.

11. The system of claim 1, wherein the control macro is further structured to balance the random number generator at a matched frequency of the circuit, creating a random number seed that sets an ever changing transmitting signal such that electrical emissions of active circuits are corrupted when monitored by a listening device.

12. A system structured to mask data from a circuit, comprising:

a random number generator coupled to a circuit;

a low noise amplifier coupled to the random number generator;

an antenna coupled to the low noise amplifier;

a mixer coupled to the low noise amplifier, wherein the random number generator is operated at a frequency consistent with the circuit or a function of the circuit to be protected and generates random data superimposed on native electromagnetic interference (EMI) emissions originating from the circuit or the function of the circuit to be protected, the antenna transmits the random data to mask the data of the circuit to be protected, and the mixer provides a reduced current consumption and performs power amplification as needed at the output, and a resulting modulated signal is output to the antenna without an intermediate power amplification stage; and a control macro which is structured to balance the random number generator at a matched frequency of the circuit, creating a random number seed that sets an ever changing transmitting signal such that electrical emissions of active circuits are corrupted when monitored by a listening device, and further determines a decrease in clock rate frequency when battery power is running low and provides updated information to the random number generator which then uses the updated information to adjust its frequency consistent with that of a clock rate frequency.

13. The system of claim 12, wherein the random data of the random number generator masks the native electromagnetic interference (EMI) emissions originating from the circuit to be protected and the random data superimposed on the native EMI emissions cannot be filtered.

14. The system of claim 12, a wherein the control macro is further structured to determine an operating frequency of the circuit and to synchronize a frequency of the random number generator with that of the circuit.

15. The system of claim 12, wherein the mixer accepts as its input frequencies from the random number generator and presents at its output at least one of: (i) a signal equal in frequency to a sum of the frequencies, (ii) a signal equal in frequency to a difference between the frequencies, and (iii) the frequencies from the random number generator.

16. The system of claim 12, wherein the antenna is a high gain antenna which has a power output sufficient to mask bus traffic of the circuit, and not interfere with driver functions.

17. The system of claim 12, wherein the random number generator is extended to a plurality of internal data paths or active circuits.

18. The system of claim 12, wherein the random number generator provides cover of ongoing background functions and sufficient replacement seeds can be queued up and phased over to new random patterns at a sufficient rate to prevent external reverse engineering of any data of the circuit.

19. A method comprising:

generating random data through a random number generator which matches a frequency of a circuit to be protected;

superimposing the random data on native electromagnetic interference (EMI) emissions originating from a circuit or function of the circuit to be protected and at a frequency consistent with the circuit or the function of the circuit to be protected so that the random data superimposed on the native EMI emissions cannot be filtered;

mixing the random data so as to create a modulated signal with a reduced current consumption;

transmitting the modulated signal such that the transmitted random data masks the native electromagnetic interference (EMI) emissions originating from the circuit or the function of the circuit to be protected;

balancing the random number generator at a matched frequency of the circuit and creating a random number seed that sets an ever changing transmitting signal such that electrical emissions of active circuits are corrupted when monitored by a listening device; and determining a decrease in clock rate frequency when battery power is running low and providing such updated information to the random number generator which then uses the updated information to adjust its frequency consistent with that of a clock rate frequency.

20. The method of claim 19, further comprising providing the frequency of the circuit to a random number generator for matching its own frequency with that of the provided frequency.

21. A system comprising:

a random number generator which matches a frequency of a circuit to be protected, and which generates a random signal to be superimposed on data;

a low noise amplifier which receives the random signal from the random number generator;

an antenna which receives the random signal from the low noise amplifier and transmits the random signal to mask the data of the circuit to be protected; and a control macro which is structured to balance the random number generator at a matched frequency of the circuit, creating a random number seed that sets an ever changing transmitting signal such that electrical emissions of active circuits are corrupted when monitored by a listening device, wherein:

the random signal superimposed on the data cannot be filtered from the data; and the control macro determines a decrease in clock rate frequency when battery power is running low and provides such updated information to the random number generator which then uses the updated information to adjust its frequency consistent with that of a clock rate frequency.

22. The system of claim 21, further comprising a mixer which provides a reduced current consumption and performs power amplification as needed at the output, and a resulting modulated signal is output to the antenna without an intermediate power amplification stage.

23. The system of claim 22, wherein the output of the low noise amplifier is timed at precisely an instruction and data bus frequency, and fed to the antenna.

* * * * *